US012241324B1

(12) United States Patent
Breaux et al.

(10) Patent No.: US 12,241,324 B1
(45) Date of Patent: Mar. 4, 2025

(54) WEDGE PIN FOR DOWNHOLE TOOL

(71) Applicant: Halliburton Energy Services, Inc., Houston, TX (US)

(72) Inventors: Brian Breaux, Houston, TX (US); Mark Solly, Spring, TX (US); James Howell Cobb, Cypress, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 0 days.

(21) Appl. No.: 18/454,924

(22) Filed: Aug. 24, 2023

(51) Int. Cl.
*E21B 23/01* (2006.01)
*E21B 47/017* (2012.01)

(52) U.S. Cl.
CPC ..... *E21B 23/01* (2013.01); *E21B 47/017* (2020.05)

(58) Field of Classification Search
CPC ..... E21B 17/06; E21B 23/01; E21B 23/02; E21B 23/03
See application file for complete search history.

(56) References Cited

U.S. PATENT DOCUMENTS

2002/0144820 A1 10/2002 Thomas et al.
2013/0140019 A1* 6/2013 Pare ..... E21B 17/06 166/117.5
2014/0069652 A1 3/2014 Gay et al.
2015/0226017 A1 8/2015 Telfer
2015/0368989 A1 12/2015 Lauder et al.
2016/0040499 A1* 2/2016 Cain ..... E21B 23/01 166/85.1
2016/0090793 A1 3/2016 Pare et al.
2016/0186520 A1* 6/2016 Nguyen ..... E21B 33/03 166/217
2016/0281442 A1* 9/2016 Stokes ..... E21B 23/00
2017/0285208 A1* 10/2017 Castillo ..... E21B 49/00

OTHER PUBLICATIONS

International Patent Application No. PCT/US2023/072783, International Search Report and Written Opinion mailed May 24, 2024, 10 pages.

* cited by examiner

*Primary Examiner* — Robert E Fuller
*Assistant Examiner* — Lamia Quaim
(74) *Attorney, Agent, or Firm* — Kilpatrick Townsend & Stockton LLP

(57) ABSTRACT

A system can be used to control shock applied to a downhole tool. The system can include an internal component, an outer component, and a wedge pin. The internal component can be positioned in the downhole tool. The internal component can include an axial shoulder and an angled seating surface. The outer component can be positioned in the downhole tool. The outer component can include (i) an opening sized to receive a preload cap, and (ii) a flange positionable to contact the axial shoulder. The wedge pin can be positioned in the opening and abutting the angled seating surface to apply a preload to the internal component and the outer component in response to the preload cap being positioned in the opening.

18 Claims, 5 Drawing Sheets

WEDGE PIN FOR DOWNHOLE TOOL

TECHNICAL FIELD

The present disclosure relates generally to wellbore operations and, more particularly (although not necessarily exclusively), to a wedge pin for a downhole tool.

BACKGROUND

Wellbore operations may include various equipment, components, methods, or techniques to form a wellbore, to displace and release hydrocarbon fluids using a wellbore or flowline, and the like. The wellbore operations can include one or more downhole tools that can be positioned in a wellbore to, for example, image the wellbore, analyze the wellbore, or perform other suitable tasks in the wellbore. The one or more downhole tools may include sensitive equipment that may not tolerate shock, vibrations, or other disturbances such as those that can be experienced in the wellbore. Controlling the disturbances to protect the sensitive equipment can be technically challenging.

DETAILED DESCRIPTION

Figure 1:
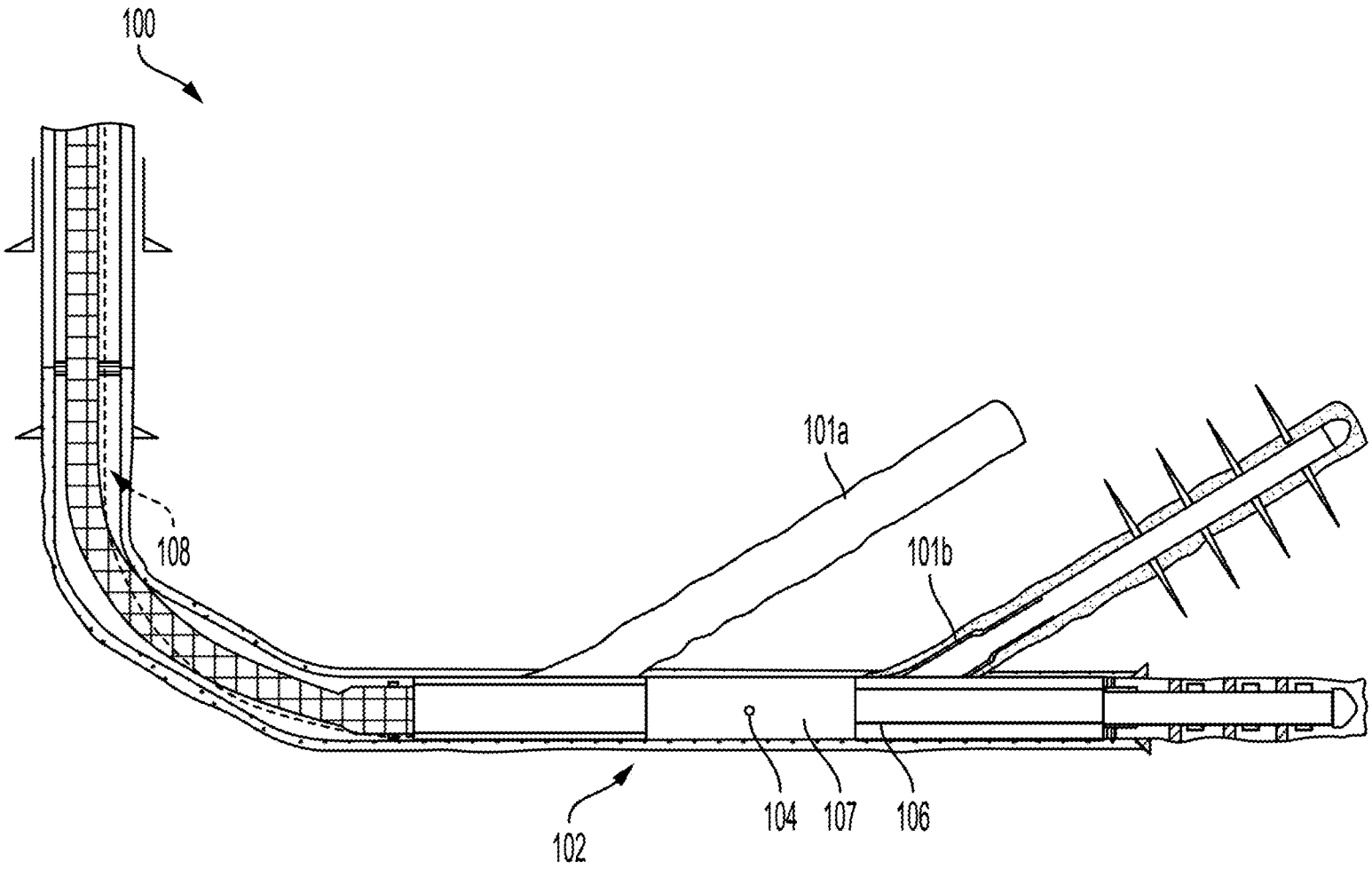
FIG. 1 is a sectional view of a wellbore that has a downhole tool that includes a wedge pin according to one example of the present disclosure.

Certain aspects and examples of the present disclosure relate to a wedge pin for a downhole tool. The downhole tool may be or include an imaging tool, a sensor tool, or any other suitable type of downhole tool that can be positioned in a wellbore. The downhole tool can include an outer component, such as an outer collar, and an internal component, which may include fragile equipment, sensitive equipment, and the like. The wedge pin can be positioned in the downhole tool to mitigate or eliminate damage to the internal component, or any sub-component included therein, and the wedge pin can be used apply a preload in at least two directions to the downhole tool. For example, the wedge pin can apply an axial preload, a torsional preload, or a combination thereof on the downhole tool. In some examples, the wedge pin can be compressed or otherwise deformed to control an amount of preload applied to the downhole tool.

A downhole tool can experience shock conditions, vibration conditions, and the like during operation such as in a wellbore. In a particular example, the downhole tool can be or include an imaging tool, such as a nuclear magnetic resonance (NMR) or magnetic resonance imaging (MRI) tool, that can include a heavy cylindrical core with sensitive components. Shock forces, vibration forces, and the like can occur along a direction of an axis of the downhole tool, torsionally about the axis of the downhole tool, or in other directions. Internal components, such as heavy cylindrical components, sensitive imagery equipment, and the like, positioned in the downhole tool can be jarred loose, can be damaged, or may suffer other negative consequences of the shock forces, the vibration forces, etc. Additionally or alternatively, manufacturing tolerances may contribute to a risk associated with damage to the internal components of the downhole tool.

A downhole tool with a wedge pin can be used to reduce or mitigate damage to, or loosening of, internal components of the downhole tool. In some examples, the downhole tool may include an internal component and an external component such as an outer collar that may be positioned concentrically exterior with respect to the internal component. The outer component may be secured, for example using the wedge pin, to the internal component in such a way as to mitigate or eliminate torsional motion or shock, axial motion or shock, or a combination thereof. The wedge pin, and any other component used for securing the outer component to the internal component to resist torsional motion or axial motion, can be designed such that manufacturing variances may not alter a performance of the wedge pin, any other component, or a combination thereof.

The wedge pin may include one or more pins that can be sized, shaped, or a combination thereof to generate a preloaded coupling between the outer component and the internal component. The wedge pin can translate a radial force, which may be generated by its installation in the downhole tool, into an axial force that may be used to drive the internal component into the external component to establish an axial preload. The axial preload may resist axial forces that occur in the downhole tool and may provide frictional forces that resist torsional forces experienced downhole. Additionally or alternatively, the wedge pin may compress or otherwise deform under threshold amounts of pressure. In some examples, and instead of compressing the wedge pin, one or more disc springs can be used to apply compression force to the wedge pin.

A downhole tool can include an internal component and an outer component. Additionally or alternatively, the downhole tool can include a wedge pin, a preload cap, and any other suitable components for the downhole tool. In some examples, the outer component, the internal component, or a combination thereof may include the wedge pin, the preload cap, or a combination thereof. The internal component may include an axial shoulder that can define a surface against which at least a portion (e.g., a flange) of the outer component can be positioned. The wedge pin, the preload cap, or a combination thereof can be installed in the downhole tool such as via pressing the wedge pin through the outer component and the internal component to be seated against at least a portion (e.g., an angled seating surface) of the internal component, etc. The preload cap can thread onto the outer component to compress the wedge pin against one or more surfaces of the internal component. In some examples, the preload cap can be torqued to compress the wedge pin to a desired level of preload. Additionally or alternatively, the preload cap can be torqued or otherwise installed on the outer component to seat against a preload cap shoulder positioned on the outer component.

In some examples, the internal component may include an angled seating surface that can match a trajectory of a bottom surface of the wedge pin. When installed in the downhole tool, the wedge pin may seat against the angled seating surface and may be compressed by the preload cap against the angled seating surface. The angled seating surface can cause at least a portion of force applied by the wedge pin to be applied as an axial force along an axis, such as a longitudinal axis, of the downhole tool. The axial force can draw the internal component and the outer component together, which may result in an axial preload applied to the axial shoulder. The axial preload may be large enough to prevent or mitigate movement of the internal component when the downhole tool experiences shock forces or vibration forces. In some examples, one wedge pin and preload cap can be used, two wedge pins and preload caps can be used, three wedge pins and preload caps can be used, and so on.

In some examples, sufficient torsional preload may be applied to the wedge pin, for example via the preload cap, to resist torsional movement. The torsional preload may apply at least a frictional force to the axial shoulder to resist torsional movement. Additionally or alternatively, the internal component, the outer component, the wedge pin, and the preload cap, when installed together, may form a structure that may be resistant to rotation of the internal component about a longitudinal axis extending through the downhole tool.

These illustrative examples are given to introduce the reader to the general subject matter discussed herein and are not intended to limit the scope of the disclosed concepts. The following sections describe various additional features and examples with reference to the drawings in which like numerals indicate like elements, and directional descriptions are used to describe the illustrative aspects, but, like the illustrative aspects, should not be used to limit the present disclosure.

FIG. 1 is a sectional view of a wellbore 100 that has a downhole tool 102 that includes a wedge pin 104 according to one example of the present disclosure. As illustrated in FIG. 1, the wellbore 100 may be positioned adjacent to a first lateral wellbore 101*a* and a second lateral wellbore 101*b*, both of which may originate from a different point along the wellbore 100, though the first lateral wellbore 101*a* and the second lateral wellbore 101*b* may be optional. As illustrated in FIG. 1, the downhole tool 102 can be positioned in the wellbore 100 and may be positioned in any suitable location within the wellbore 100 to perform one or more tasks such as imaging at least a portion of the wellbore 100, measuring other parameters of the wellbore 100, and the like. The downhole tool 102 can be positioned in the wellbore 100 using a work string 108 or using any other suitable conveyance tools or operations that can position the downhole tool 102 in the wellbore 100.

The downhole tool 102 can include an internal component 106, an outer component 107, and any other suitable components for the downhole tool 102. In some examples, the outer component 107 can be or include an outer collar or other outer component that can connect with the internal component 106. Additionally or alternatively, the internal component 106 may be or include imaging equipment, sensors, detectors, or other sensitive or fragile equipment. In a particular example, the internal component 106 may be or include a heavy cylindrical component that may house magnetic resonance imaging (MRI) equipment. The internal component 106 may be positioned concentrically interior with respect to the outer component 107, and the wedge pin 104 may be used to connect the internal component 106 and the outer component 107.

The wedge pin 104 may include one pin, two pins, three pins, four pins, and so on for connecting the internal component 106 and the outer component 107 and for applying a preload in at least one direction to the downhole tool 102. Additionally or alternatively, the wedge pin 104 may be or include a combination of different types of parts such as a compressible pin, a preload cap, and the like. The wedge pin 104 may be installed in the downhole tool 102 prior to the downhole tool 102 being positioned in the wellbore 100, substantially contemporaneously with respect to the downhole tool 102 being positioned in the wellbore 100, etc. The wedge pin 104 may apply the preload to the downhole tool 102 to mitigate or eliminate shock forces in one or more directions, such as an axial direction, a torsional direction, etc., experienced by the downhole tool 102 to reduce or eliminate damage experienced by the internal component 106.

Figure 2:
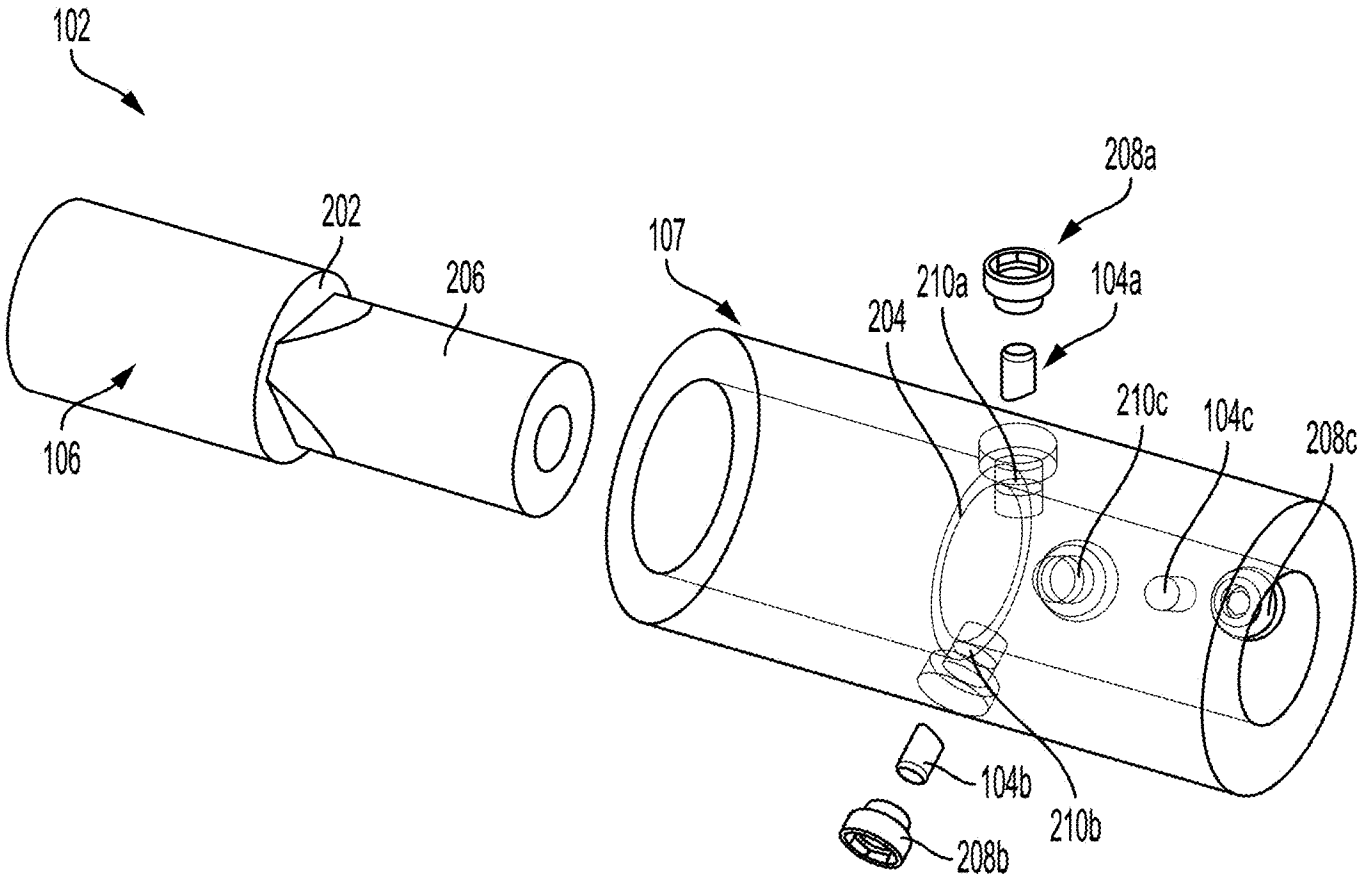
FIG. 2 is an exploded perspective view of a downhole tool that includes a wedge pin according to one example of the present disclosure.

FIG. 2 is an exploded perspective view of a downhole tool 102 that includes a wedge pin 104 according to one example of the present disclosure. As illustrated in FIG. 2, the downhole tool 102 can include the internal component 106 and the outer component 107. The internal component 106 may include an axial shoulder 202 against which a flange 204 of the outer component 107 can be positioned, for example when at least a portion 206 of the internal component 106 is positioned concentrically interior with respect to the outer component 107. The portion 206 of the internal component 106 can be positioned in the outer component 107 and can be secured in place using, for example, at least one wedge pin, such as wedge pin 104, and at least one preload cap such as preload cap 208.

As illustrated, three wedge pins 104*a-c* and three preload caps 208*a-c* are used to secure the internal component 106 and the outer component 107, though any other suitable number (e.g., less than three or more than three) of wedge pins or preload caps may be used to secure the internal component 106 and the outer component 107. Each wedge pin of the three wedge pins 104*a-c* may be positioned through a corresponding opening of openings 210*a-c* of the outer component 107. Additionally or alternatively, each preload cap of the three preload caps 208*a-c* may be positioned over a corresponding wedge pin of the three wedge pins 104*a-c* to apply pressure to the corresponding wedge pin, deform the corresponding wedge pin, compress the wedge pin, or the like.

Figure 3:
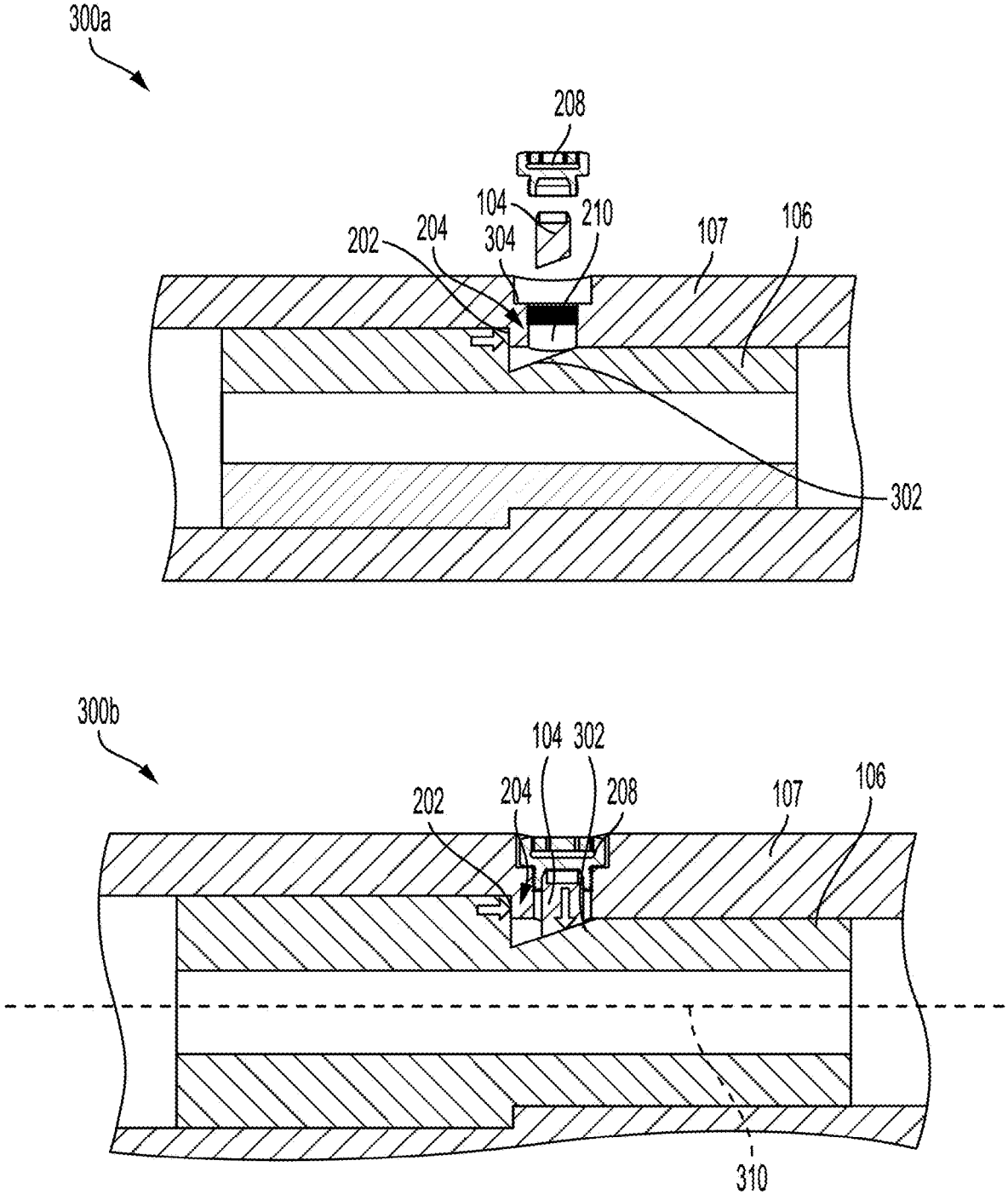
FIG. 3 is a sectional side view of a downhole tool that includes a wedge pin according to one example of the present disclosure.

FIG. 3 is a sectional side view of a downhole tool 102 that includes a wedge pin 104 according to one example of the present disclosure. As illustrated in FIG. 3, views 300*a-b* include the downhole tool 102. The view 300*a* illustrates an exploded, sectional, side view of the downhole tool 102, and the view 300*b* illustrates a sectional side view of the downhole tool 102 with components installed therein. As illustrated in the view 300*a*, the downhole tool 102 can include the internal component 106, the outer component 107, the wedge pin 104, and the preload cap 208, though the downhole tool 102 can include any other or additional components. The internal component 106 can be positioned concentrically interior with respect to the outer component 107, and the internal component 106 can include an axial shoulder 202 and an angled seating surface 302. The outer component 107 can include the flange 204, the opening 210, a cap seat 304, and any other or additional subcomponents for the outer component 107.

As illustrated in the view 300*b*, the wedge pin 104 can be positioned through the opening 210, which may be sized to receive the wedge pin 104, at least a portion of the preload cap 208, and the like. The wedge pin 104 can be positioned through the opening 210 to contact the angled seating surface 302. Additionally or alternatively, the preload cap 208 can be positioned above the wedge pin 104 contacting the wedge pin 104. The preload cap can be seated on the cap seat 304 of the outer component 107. Additionally or alternatively, the preload cap 208 can be threaded, pressed, or the like into the outer component 107 to apply pressure to compress or otherwise deform the wedge pin 104 or to otherwise apply a preload to the downhole tool 102. The preload may be applied in one or more directions with respect to the downhole tool. For example, the preload can be applied, for example via the angled seating surface 302, along a longitudinal axis 310 that extends through the downhole tool 102. In an additional example, the preload can be applied, for example, via compression of the wedge pin 104, torsionally about the longitudinal axis 310.

Figure 4:
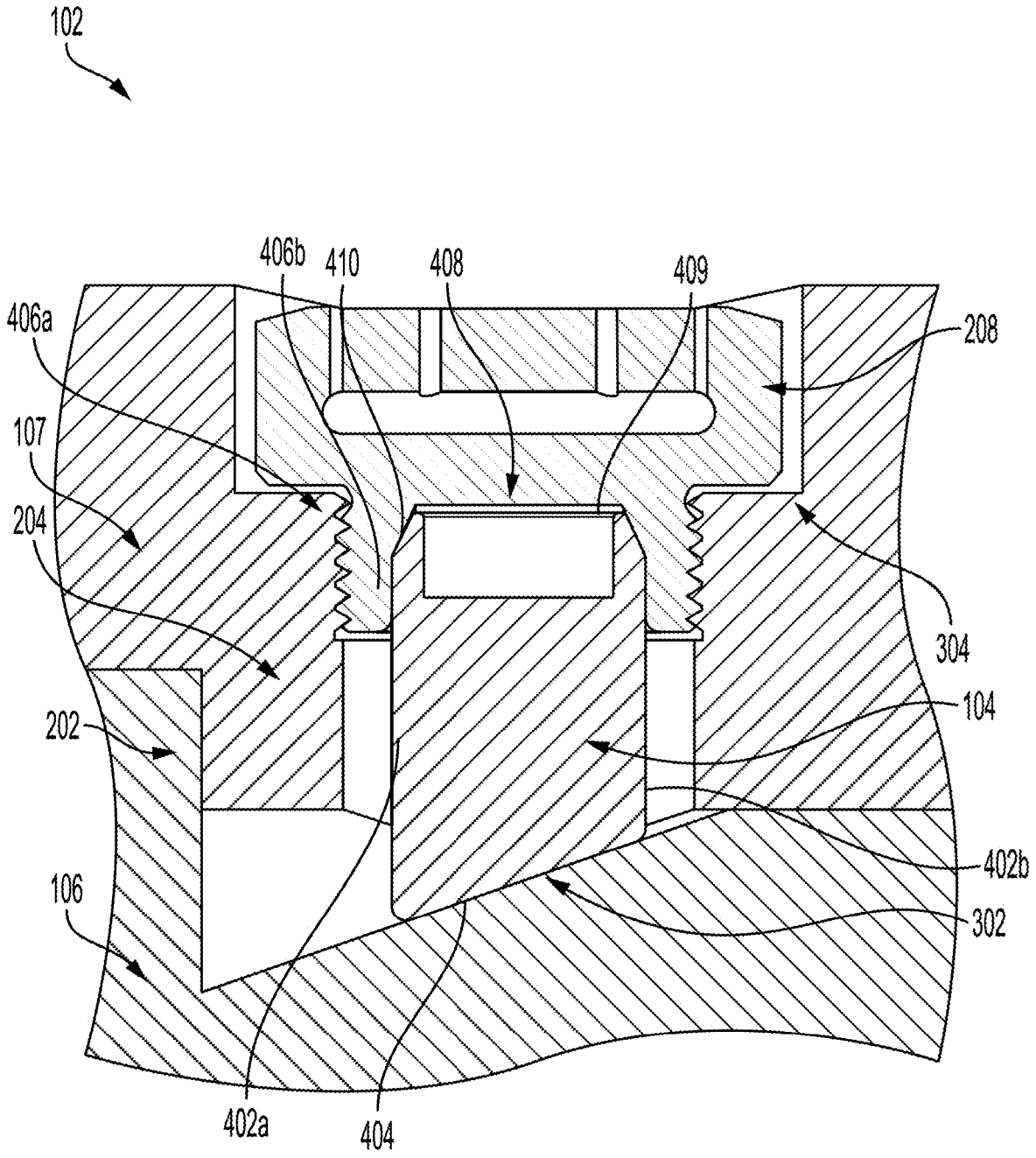
FIG. 4 is a sectional side view of a portion of a downhole tool that includes a wedge pin according to one example of the present disclosure.

FIG. 4 is a sectional side view of a portion of a downhole tool 102 that includes a wedge pin 104 according to one example of the present disclosure. The downhole tool 102 can include the internal component 106, the outer component 107, the wedge pin 104, and the preload cap 208, though any other or additional components or parts can be included in the downhole tool 102. As illustrated in FIG. 4, the wedge pin 104 is installed in the downhole tool 102, and the preload cap 208 is installed above the wedge pin 104 contacting the wedge pin 104. In some examples, the wedge pin 104 can include a pair of sides 402*a-b* that may extend approximately perpendicularly with respect to the longitudinal axis 310 when the wedge pin 104 is installed in the downhole tool 102. The pair of sides 402*a-b* may additionally or alternatively be approximately (e.g., within 5%, 10%, 15%, etc.) parallel with respect to one another. Additionally or alternatively, the wedge pin 104 can include a seating side 404 that can be angled to contact the angled seating surface 302. In some examples, the seating side 404 may have a first angle measured from the longitudinal axis 310 that may be similar or identical to a second angle of the angled seating surface 302 also measured from the longitudinal axis 310.

In some examples, the outer component 107 can include a first set of threads 406*a*, and the preload cap 208 can include a second set of threads 406*b*. The first set of threads 406*a* may be sized, shaped, and the like to receive the second set of threads 406*b* to cause the preload cap 208 to be connected to the outer component 107. The second set of threads 406*b* of the preload cap 208 can be threaded into the first set of threads 406*a* to control a preload applied by the wedge pin 104. For example, the preload cap 208 can be threaded further into the second set of threads 406*b* to increase a pressure on the wedge pin 104 to increase the preload applied by the wedge pin 104 to the downhole tool 102. In other examples, the preload cap 208 can be threaded further out of the second set of threads 406*b* to decrease a pressure on the wedge pin 104 to decrease the preload applied by the wedge pin 104 to the downhole tool 102. In some examples, the preload cap 208 can include a seating compartment 408 that may correspond to a seating shoulder 410 of the wedge pin 104. The seating compartment 408 may be sized, shaped, and the like to approximately match a trajectory of a surface of the seating shoulder 410, which may be or include a tapered region extending from a first point along at least one side of the pair of sides 402*a-b* to a second point adjacent to a compression side 409, of the wedge pin 104.

Figure 5:
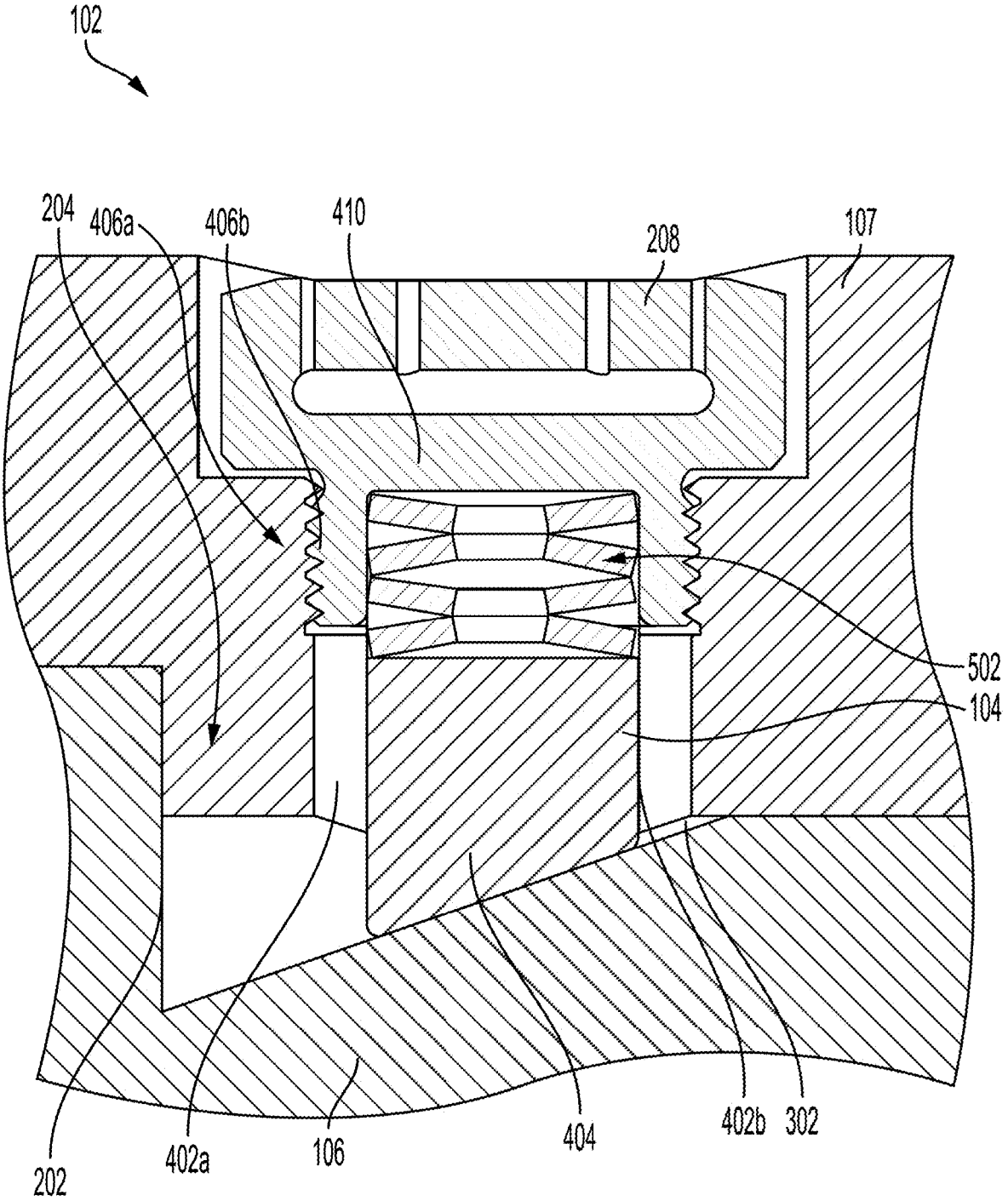
FIG. 5 is a sectional side view of a portion of a downhole tool that includes a wedge pin with a seating spring according to one example of the present disclosure.

FIG. 5 is a sectional side view of a portion of a downhole tool 102 that includes a wedge pin 104 with a seating spring 502 according to one example of the present disclosure. The downhole tool 102 can include the internal component 106, the outer component 107, the wedge pin 104, and the preload cap 208, though any other or additional components or parts can be included in the downhole tool 102. As illustrated in FIG. 4, the wedge pin 104 is installed in the downhole tool 102, and the preload cap 208 is installed above the wedge pin 104 contacting the wedge pin 104. In some examples, the wedge pin 104 can include a pair of sides 402*a-b* that may extend approximately perpendicularly with respect to the longitudinal axis 310 when the wedge pin 104 is installed in the downhole tool 102. Additionally or alternatively, the wedge pin 104 can include a seating side 404 that can be angled to contact the angled seating surface 302. In some examples, the seating side 404 may have a first angle measured from the longitudinal axis 310 that may be similar or identical to a second angle of the angled seating surface 302 also measured from the longitudinal axis 310.

In some examples, the outer component 107 can include a first set of threads 406*a*, and the preload cap 208 can include a second set of threads 406*b*. The first set of threads 406*a* may be sized, shaped, and the like to receive the second set of threads 406*b* to cause the preload cap 208 to be connected to the outer component 107. The second set of threads 406*b* of the preload cap 208 can be threaded into the first set of threads 406*a* to control a preload applied by the wedge pin 104. For example, the preload cap 208 can be threaded further into the second set of threads 406*b* to increase a pressure on the wedge pin 104 to increase the preload applied by the wedge pin 104 to the downhole tool 102. In other examples, the preload cap 208 can be threaded further out of the second set of threads 406*b* to decrease a pressure on the wedge pin 104 to decrease the preload applied by the wedge pin 104 to the downhole tool 102. In some examples, the preload cap 208 can include a seating spring 502 that may correspond to the seating shoulder 410 of the wedge pin 104. The seating spring 502 may be sized, shaped, and the like to approximately match a trajectory of a surface of the seating shoulder 410 of the wedge pin 104. The seating spring 502 may apply force from the preload cap 208 to the wedge pin 104 to cause the wedge pin 104 to apply the preload to the downhole tool 102.

In some aspects, systems and downhole tools for a wedge pin for a downhole tool are provided according to one or more of the following examples:

As used below, any reference to a series of examples is to be understood as a reference to each of those examples disjunctively (e.g., "Examples 1-4" is to be understood as "Examples 1, 2, 3, or 4").

Example 1 is a system comprising: an internal component positionable in a downhole tool usable in a wellbore, the internal component comprising an axial shoulder and an angled seating surface; an outer component positionable in the downhole tool, the outer component comprising (i) an opening sized to receive a preload cap, and (ii) a flange positionable to contact the axial shoulder; and a wedge pin positionable in the opening and abutting the angled seating surface to apply a preload to the internal component and the outer component in response to the preload cap being positioned in the opening.

Example 2 is the system of example 1, wherein the wedge pin comprises: a pair of approximately parallel sides extending approximately perpendicularly with respect to a longitudinal axis of the outer component when the wedge pin is installed in the system; and a seating side having a first angle measured from the longitudinal axis, the first angle being approximately the same as a second angle, measured from the longitudinal axis, of the angled seating surface.

Example 3 is the system of any of examples 1-2, wherein the wedge pin further comprises a tapered region that extends from a first point along at least one parallel side of the pair of approximately parallel sides to a compression side of the wedge pin, and wherein the compression side is positioned opposite the seating side about the wedge pin.

Example 4 is the system of any of examples 1-3, wherein the preload cap comprises a seating compartment that includes a second tapered region following a path of the tapered region of the wedge pin, and wherein the preload cap is installable in the system to cause the seating compartment to apply a preload force to the wedge pin.

Example 5 is the system of any of examples 1-4, wherein the wedge pin is compressible by the preload force to apply a preload comprising a friction force to the axial shoulder.

Example 6 is the system of example 1, wherein the opening of the outer component comprises a first set of threads sized to receive a second set of threads of the preload cap, and wherein the wedge pin is compressible in response to positioning the preload cap in the first set of threads to apply a preload force at least to the axial shoulder.

Example 7 is the system of example 1, wherein the internal component is a cylindrical internal component that comprises imaging equipment for performing magnetic resonance imaging operations in the wellbore.

Example 8 is a downhole tool comprising: a housing positionable in a wellbore and defining an outer component, the housing comprising (i) an opening sized to receive a wedge pin and a preload cap, and (ii) a flange positionable to contact an axial shoulder of an internal component; and the internal component positionable in the downhole tool, the internal component comprising the axial shoulder and an angled seating surface sized to receive the wedge pin to facilitate a preload to the internal component and the outer component in response to the preload cap being positioned in the opening.

Example 9 is the downhole tool of example 8, further comprising the wedge pin, wherein the wedge pin comprises: a pair of approximately parallel sides extending approximately perpendicularly with respect to a longitudinal axis of the outer component when the wedge pin is installed in the downhole tool; and a seating side having a first angle measured from the longitudinal axis, the first angle being approximately the same as a second angle, measured from the longitudinal axis, of the angled seating surface.

Example 10 is the downhole tool of any of examples 8-9, wherein the wedge pin further comprises a tapered region that extends from a first point along at least one parallel side of the pair of approximately parallel sides to a compression side of the wedge pin, and wherein the compression side is positioned opposite the seating side about the wedge pin.

Example 11 is the downhole tool of any of examples 8-10, further comprising the preload cap, wherein the preload cap comprises a seating compartment that includes a second tapered region following a path of the tapered region of the wedge pin, and wherein the preload cap is installable in the downhole tool to cause the seating compartment to apply a preload force to the wedge pin.

Example 12 is the downhole tool of any of examples 8-11, wherein the wedge pin is compressible by the preload force to apply a preload comprising a friction force to the axial shoulder.

Example 13 is the downhole tool of example 8, wherein the opening of the outer component comprises a first set of threads sized to receive a second set of threads of the preload cap, and wherein the wedge pin is compressible in response to positioning the preload cap in the first set of threads to apply a preload force at least to the axial shoulder.

Example 14 is the downhole tool of example 8, wherein the internal component is a cylindrical internal component that comprises imaging equipment for performing magnetic resonance imaging operations in the wellbore.

Example 15 is a system comprising: an internal component positionable in a downhole tool usable in a wellbore, the internal component comprising an axial shoulder and an angled seating surface; an outer component positionable in the downhole tool, the outer component comprising (i) a preload cap positionable in an opening sized to receive the preload cap radially above a wedge pin, and (ii) a flange positionable to contact the axial shoulder; and the wedge pin positionable in the opening and abutting the angled seating surface to be compressed to apply a preload in at least two directions to the internal component and the outer component in response to the preload cap being positioned in the opening.

Example 16 is the system of example 15, wherein the wedge pin comprises: a pair of approximately parallel sides extending approximately perpendicularly with respect to a longitudinal axis of the outer component when the wedge pin is installed in the system; and a seating side having a first angle measured from the longitudinal axis, the first angle being approximately the same as a second angle, measured from the longitudinal axis, of the angled seating surface.

Example 17 is the system of any of examples 15-16, wherein the wedge pin further comprises a tapered region that extends from a first point along at least one parallel side of the pair of approximately parallel sides to a compression side of the wedge pin, and wherein the compression side is positioned opposite the seating side about the wedge pin.

Example 18 is the system of any of examples 15-17, wherein the preload cap comprises a seating compartment that includes a second tapered region following a path of the tapered region of the wedge pin, wherein the preload cap is installable in the system to cause the seating compartment to apply a preload force to the wedge pin, and wherein the wedge pin is compressible by the preload force to apply a preload comprising a friction force to the axial shoulder.

Example 19 is the system of example 15, wherein the opening of the outer component comprises a first set of threads sized to receive a second set of threads of the preload cap, and wherein the wedge pin is compressible in response to positioning the preload cap in the first set of threads to apply a preload force at least to the axial shoulder.

Example 20 is the system of example 15, wherein the internal component is a cylindrical internal component that comprises imaging equipment for performing magnetic resonance imaging operations in the wellbore.

The foregoing description of certain examples, including illustrated examples, has been presented only for the purpose of illustration and description and is not intended to be exhaustive or to limit the disclosure to the precise forms disclosed. Numerous modifications, adaptations, and uses thereof will be apparent to those skilled in the art without departing from the scope of the disclosure.

What is claimed is:

1. A system comprising:

an internal component positionable in a downhole tool usable in a wellbore, the internal component comprising an axial shoulder and an angled seating surface;

an outer component positionable in the downhole tool, the outer component comprising (i) an opening sized to receive a preload cap, and (ii) a flange positionable to contact the axial shoulder; and a wedge pin positionable in the opening and abutting the angled seating surface to apply a preload to the internal component and the outer component in response to the preload cap being positioned in the opening, wherein the preload cap comprises a seating compartment that includes a first tapered region that is positionable to follow a path of a second tapered region of the wedge pin, and wherein the preload cap is installable in the downhole tool to cause the seating compartment to apply a preload force to the wedge pin.

2. The system of claim 1, wherein the wedge pin comprises:

a pair of approximately parallel sides extending approximately perpendicularly with respect to a longitudinal axis of the outer component when the wedge pin is installed in the system; and a seating side having a first angle measured from the longitudinal axis, the first angle being approximately the same as a second angle, measured from the longitudinal axis, of the angled seating surface.

3. The system of claim 2, wherein the wedge pin further comprises a tapered region that extends from a first point along at least one parallel side of the pair of approximately parallel sides to a compression side of the wedge pin, and wherein the compression side is positioned opposite the seating side about the wedge pin.

4. The system of claim 1, wherein the wedge pin is compressible by the preload force to apply a preload comprising a friction force to the axial shoulder.

5. The system of claim 1, wherein the opening of the outer component comprises a first set of threads sized to receive a second set of threads of the preload cap, and wherein the wedge pin is compressible in response to positioning the preload cap in the first set of threads to apply a preload force at least to the axial shoulder.

6. The system of claim 1, wherein the internal component is a cylindrical internal component that comprises imaging equipment for performing magnetic resonance imaging operations in the wellbore.

7. A downhole tool comprising:

a housing positionable in a wellbore and defining an outer component, the housing comprising (i) an opening sized to receive a wedge pin and a preload cap, and (ii) a flange positionable to contact an axial shoulder of an internal component; and the internal component positionable in the downhole tool, the internal component comprising the axial shoulder and an angled seating surface sized to receive the wedge pin to facilitate a preload to the internal component and the outer component in response to the preload cap being positioned in the opening, wherein the preload cap comprises a seating compartment that includes a first tapered region that is positionable to follow a path of a second tapered region of the wedge pin, and wherein the preload cap is installable in the downhole tool to cause the seating compartment to apply a preload force to the wedge pin.

8. The downhole tool of claim 7, further comprising the wedge pin, wherein the wedge pin comprises:

a pair of approximately parallel sides extending approximately perpendicularly with respect to a longitudinal axis of the outer component when the wedge pin is installed in the downhole tool; and a seating side having a first angle measured from the longitudinal axis, the first angle being approximately the same as a second angle, measured from the longitudinal axis, of the angled seating surface.

9. The downhole tool of claim 8, wherein the wedge pin further comprises a tapered region that extends from a first point along at least one parallel side of the pair of approximately parallel sides to a compression side of the wedge pin, and wherein the compression side is positioned opposite the seating side about the wedge pin.

10. The downhole tool of claim 7, wherein the wedge pin is compressible by the preload force to apply a preload comprising a friction force to the axial shoulder.

11. The downhole tool of claim 7, wherein the opening of the outer component comprises a first set of threads sized to receive a second set of threads of the preload cap, and wherein the wedge pin is compressible in response to positioning the preload cap in the first set of threads to apply a preload force at least to the axial shoulder.

12. The downhole tool of claim 7, wherein the internal component is a cylindrical internal component that comprises imaging equipment for performing magnetic resonance imaging operations in the wellbore.

13. A system comprising:

an internal component positionable in a downhole tool usable in a wellbore, the internal component comprising an axial shoulder and an angled seating surface;

an outer component positionable in the downhole tool, the outer component comprising (i) a preload cap positionable in an opening sized to receive the preload cap radially above a wedge pin, and (ii) a flange positionable to contact the axial shoulder; and the wedge pin positionable in the opening and abutting the angled seating surface to be compressed to apply a preload in at least two directions to the internal component and the outer component in response to the preload cap being positioned in the opening, wherein the preload cap comprises a seating compartment that includes a first tapered region that is positionable to follow a path of a second tapered region of the wedge pin, and wherein the preload cap is installable in the downhole tool to cause the seating compartment to apply a preload force to the wedge pin.

14. The system of claim 13, wherein the wedge pin comprises:

a pair of approximately parallel sides extending approximately perpendicularly with respect to a longitudinal axis of the outer component when the wedge pin is installed in the system; and a seating side having a first angle measured from the longitudinal axis, the first angle being approximately the same as a second angle, measured from the longitudinal axis, of the angled seating surface.

15. The system of claim 14, wherein the wedge pin further comprises a tapered region that extends from a first point along at least one parallel side of the pair of approximately parallel sides to a compression side of the wedge pin, and wherein the compression side is positioned opposite the seating side about the wedge pin.

16. The system of claim 15, wherein the wedge pin is compressible by the preload force to apply a preload comprising a friction force to the axial shoulder.

17. The system of claim 13, wherein the opening of the outer component comprises a first set of threads sized to receive a second set of threads of the preload cap, and wherein the wedge pin is compressible in response to positioning the preload cap in the first set of threads to apply a preload force at least to the axial shoulder.

18. The system of claim 13, wherein the internal component is a cylindrical internal component that comprises imaging equipment for performing magnetic resonance imaging operations in the wellbore.

* * * * *